United States Patent [19]

Beretta

[11] Patent Number: 4,768,302

[45] Date of Patent: Sep. 6, 1988

[54] DECOCKING MECHANISM FOR PISTOL WITH AUTOMATIC FIRING PIN SAFETY

[75] Inventor: Pier G. Beretta, Gardone V.T., Italy

[73] Assignee: Fabrica d'Armi P. Beretta S.p.A., Italy

[21] Appl. No.: 27,156

[22] Filed: Mar. 17, 1987

[30] Foreign Application Priority Data

Mar. 21, 1986 [IT] Italy ..... 5146 A/86

[51] Int. Cl.[4] ..... F41C 17/04

[52] U.S. Cl. ..... 42/70.08

[58] Field of Search ..... 42/70.08; 89/148

[56] References Cited

U.S. PATENT DOCUMENTS 4,306,487 12/1981 Beretta ..... 42/70.08 X 4,555,861 12/1985 Khoury ..... 42/70.08 X

OTHER PUBLICATIONS

"Astra A-80 Pistol", *American Rifleman,* vol. 129, No. 9.

"This DA Auto Handles Five Calibers", *Shooting Times,* May 1974.

*Primary Examiner*—Ted L. Parr

*Attorney, Agent, or Firm*—McGlew and Tuttle

[57] ABSTRACT

A safety device for an automatic pistol of the double action type includes an automatic safety on the firing pin and has a striking lever for the hammer. The device comprises a cammed shaft, rotatably mounted to a breech block of the pistol and displaceable manually in one direction for control of the lever for disengagement of the hammer. The cam shaft is rotatable in an opposite direction by means of a spring-loaded piston for blocking the shaft in a rest position where it does not interfere with firing of the pistol.

3 Claims, 3 Drawing Sheets

DECOCKING MECHANISM FOR PISTOL WITH AUTOMATIC FIRING PIN SAFETY

FIELD AND BACKGROUND OF THE INVENTION

The present invention relates in general to automatic pistols having automatic safety on their firing pin, and in particular to a new and useful device for the automatic return to rest or to an inoperative position of the striking mechanism for the hammer of such a pistol.

In the field of safety devices for automatic pistols, automatic safety devices are known for the firing pin of the weapon. These safety devices are capable of preventing the operation of the pin and thus the firing of a bullet from the barrel of the weapon, as a result of an accidental dropping of the weapon and/or of an involuntary and uncontrolled action of the hammer on the firing pin itself. Such a device comprises a safety block mounted on the breech block of the firing pin of the pistol (hereinafter called the carriage) in a plane perpendicular to the axis of the firing pin and in an intercepting and blocking position of the firing pin, when the trigger is at rest. The safety block is normally in a working position for blocking the firing pin and is displaced to the rest or inoperative position for freeing the firing pin, only at the moment when the hammer is disengaged by the trigger.

Another known safety device, which is the subject of a patent issued to the present applicant, concerns automatic pistols of the type having a so-called "interrupted firing pin". This device comprises a safety shaft or rod, which is manually operative and interacting with the firing pin so as to neutralize the action thereof. The safety shaft or rod also interacts through the action of an intermediate lever, with a trip lever of the hammer, so as to automatically disengage the hammer immediately following the neutralization of the firing pin. The firing pin is blocked by two elements, a spring-actuated frontal one and a rear one that is mounted on the safety shaft or rod and which is positionable by their axially or non-axially with respect to the frontal element mentioned above, in order to activate and, respectfully neutralize the firing pin.

According to the known art and technique, the safety shaft and rod is rotated on the breech block and is mounted in a direction which is transverse to the firing pin. Further, it is provided with a cammed portion which controls the intermediate lever that is interacting with the tripped lever for the automatic disengagement of the hammer, when the shaft or rod is rotated to neutralize the action of the interrupted firing pin.

In practice, the safety rod or shaft must be displaced manually, and therefore, voluntarily, by means of a control lever both in the working position and in the rest position, which positions are determined and defined by at least one spring spring-loaded lever means. According to the above described arrangement, the safety shaft rod, when in the safety working position, may control a small spring loaded piston that interacts with the tripping mechanism connected to the trigger which actuates the trip lever of the hammer.

The tripping mechanism is then moved away from the trip lever, so as to avoid the posibility that the user might act on the tripping mechanism when the weapon is in the safety position.

A pistol may now be provided, concurrently, with the automatic safety blocking mechanism on the firing pin and with an automatic disengaging device for the hammer when the weapon is in its safety position. Under these circumstances, since the automatic safety blocking device on the firing pin is always operative until the trigger is acted upon, it is no longer necessary to also have a manually operated safety device or some means for moving the trigger mechanism away from the trip lever.

There remains, nevertheless, the need for means for the disengagement and the striking of the hammer, when the weapon is not to be used. These means for the disengagment of the hammer should, however, return automatically, after each action thereof, to a rest position corresponding to the position of readiness to fire the weapon. This is necessary in order not to impede or delay immediate reuse of the pistol without any manual intervention.

SUMMARY OF THE INVENTION

Starting from the above described premise, it is an object of the present invention to provide a device which is applicable to automatic pistols of the type having automatic safety means on the firing pin and a lever for the manual striking of the hammer, which device allows the automatic return to a rest or operative position of the striking means of the hammer, so as to leave the weapon always in a position of readiness and immediate reuse.

It is another object of the present invention to provide a device for the automatic return to a rest or inoperative position of the striking means of the hammer, which device employs and exploits the very same safety element described hereinabove, althouth structurally differently arranged.

It is possible, therefore, to obtain the advantage of having a device mounted on the breech block and free of the danger of being inadvertently actuated and of uncontrollably disengaging the cocked hammer, in the event of a rapid operation of the carriage itself during the arming of the pistol.

For this purpose, the present invention is directed to a device for the automatic return to a rest or inoperative position of the striking means of the hammer of pistols with automatic safety devices on the firing pin, wherein the firing pin is displaceable to a rest position by means of kinetic action controlled by the trigger of the pistol, the striking mechanism comprising a cammed, rotating shaft transversely mounted on the breech block, the breech block carrying a "so-called interrupted" type firing pin, and a rocking lever actuated by the rotation of the cammed shaft for the disengagement of the hammer by means of a trip lever in the hammer, the shaft carrying a portion of the firing pin, the portion being positionable in and out of alignment with respect to another portion of the firing pin, the device being characterized in that the cammed rotating shaft is manually displaceable in the working direction to determine the disengagement of the hammer, and automatically in the opposite direction to return to the rest position by means of a spring-loaded piston, the piston acting eccentrically on the shaft in an oblique direction with respect to the axis shaft.

A still further object of the invention is to provide a device for the automatic return of a striking mechanism for the hammer of a pistol having an automatic safety block which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
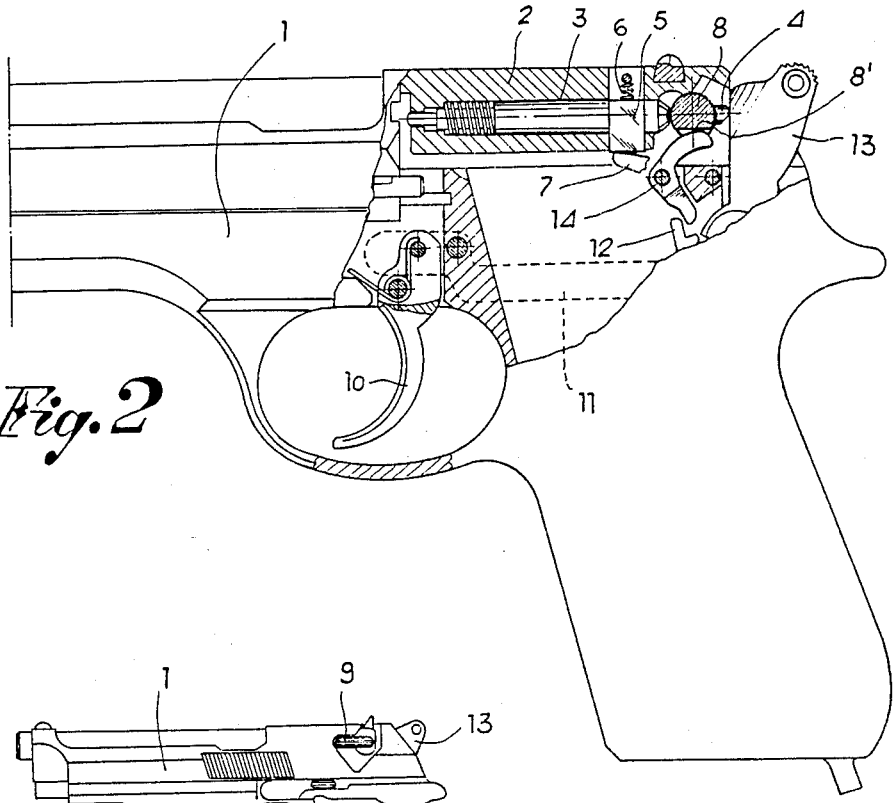
FIG. 2 is a partial, longitudinal sectional view of the pistol, taken in the plane of the firing pin and partly in elevation.
Figure 1:
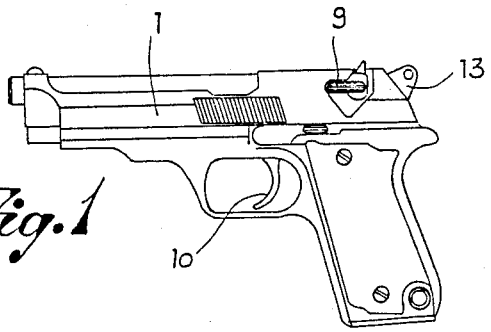
FIG. 1 is a side elevational view of an automatic pistol including the device of the present invention.
Figure 3:
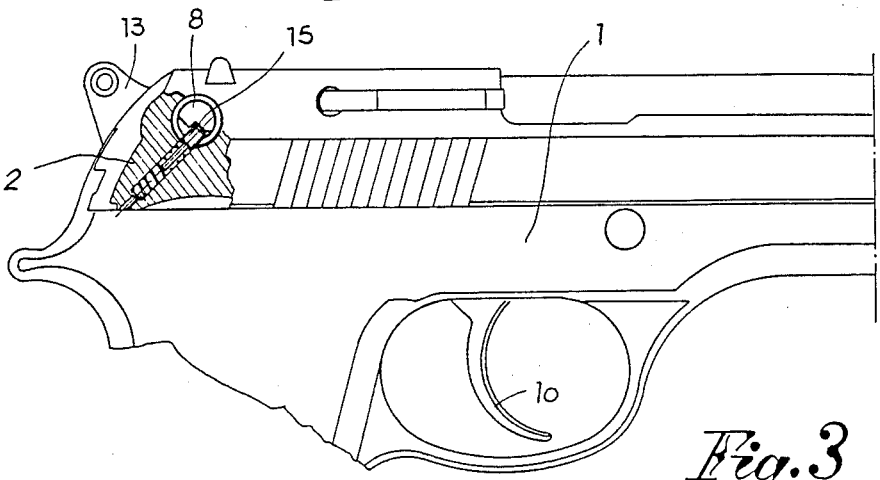
FIG. 3 is a partial sectional, side view of the pistol, opposite to the view of FIG. 2.

Referring now to FIGS. 1 through 3, a breech block 2 for the firing pin is mounted in a known manner to the body 1 of the pistol. The firing pin is of the so-called "interrupted" type and comprises a spring-loaded, frontal element 3 and a rear element 4 that can be positioned either axially or non-axially with respect to the frontal element for the actuation and, respectively, neutralization of the firing pin.

The frontal element is associated with an automatic safety block 5 mounted on the breech block 2 in a direction perpendicular to the axis of firing pin and movable from a first position, in which it intercepts and blocks the firing pin, to a second position, in which it is at rest, so as to allow the firing pin to be operative. The safety block 5 is normally kept in the working position by a spring 6, which acts in a downward direction and is moved upwardly to a rest position by a rocking lever 7.

The rear element 4 of the firing pin, on the other hand, is mounted on a rotating shaft or rod 8 positioned transversely on the breech block 2 and provided at one extremity thereof, with a control lever 9.

The pistol further comprises a trigger 10, to which is connected one extremity of a tripping mechanism 11. The opposite extremity of the tripping mechanism 11 cooperates, in a manner known per se, with a trip lever 12 (for the engagement and disengagement of the hammer 13), with the hammer itself and with the rocking lever 7 (for the displacement of the safety block 5 of the firing pin to a rest position, when the trigger is acted upon). The rotating shaft 8 is provided with a cammed portion defined by a levelling or abatement 8' and cooperates, in a manner already known, with a rocking lever 14, which in turn serves to displace the trip lever 12, so that the hammer 13 might be disengaged each time the shaft is rotated by the manual operation of the control lever 9.

In order to disengage the hammer 13, when the weapon is not to be used, it is sufficient to rotate the shaft 8, obtaining at the same time a displacement of the rear element 4 of the firing pin, axially disaligned with respect to the frontal element 3. The firing pin will concurrently be neutralized, even if temporarily.

The shaft 8 is in fact so arranged so as to automatically return to its original rest or inoperative position as soon as the manual action on it (which caused its original displacement) ceases. This will result in the realignment of the rear element 4 of the firing pin with the frontal element 3, so that the weapon is now ready for its successive employment without further manual intervention.

Figure 4:
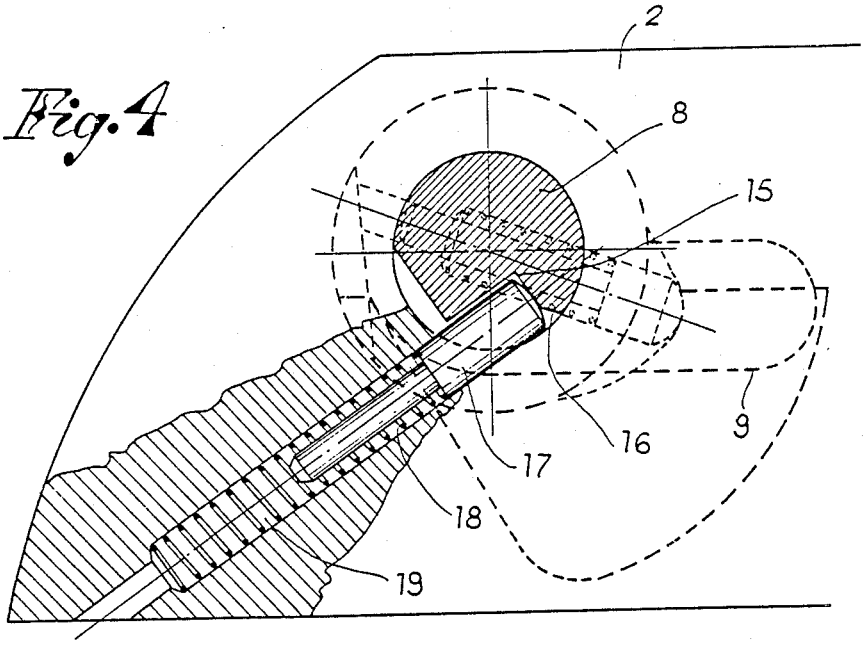
FIGS. 4, 5 and 6 are sectional views showing three consecutive positions of the rotating shaft or rod which controls the disengagement of the hammer.
Figure 5:
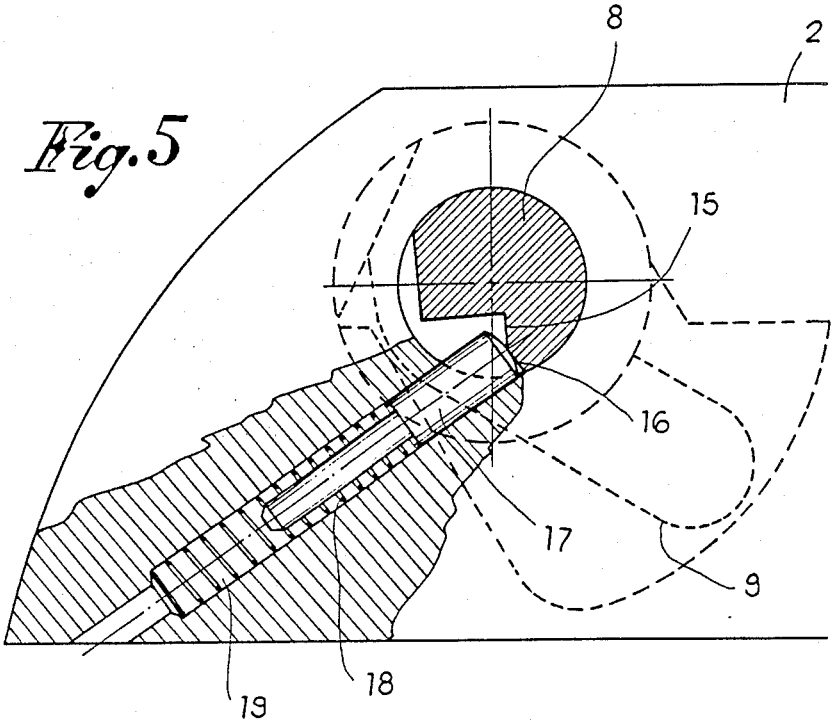
Figure 6:
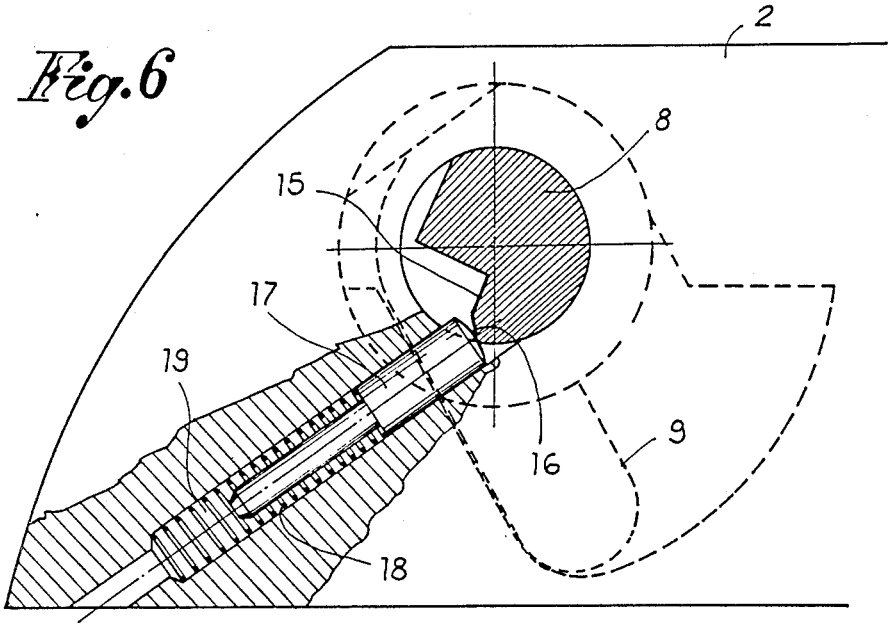

To this effect, the shaft 8 is provided on its extremity opposite to that which is connected to the control lever, with a step 15 eccentrically made with respect to the axis of the shaft. The shaft is, further, provided with a radial plane or surface 16, which is connected with the step 15 on the outer surface of the shaft. Step 15 is associated with a piston-like pusher 17 urged by a precompressed spring 18. Both pusher 17 and spring 18 are seated or positioned in a seat 19 provided in the sides of the breech block 2 and are oriented in a tangential direction with respect to the shaft 8. The action of the spring-actuated piston 17,18 against the eccentric step 15 of the shaft 8 creates a torque force moment which tends to keep the shaft in the rest or inoperative position (see FIG. 4) and to return it automatically to this position after each rotation thereof (see FIG. 6). In fact, when the safety is rotated to the working position for the disengagement of the hammer, the spring 18 is loaded further, thus increasing the torque which permits the return of the shaft to its original position. On the other hand, when the shaft is fully rotated in the working position (see FIG. 6), the spring loaded piston 17,18 is in position to act against the radial plane or surface 16, positioned at its maximum distance from the axis of the shaft, so that the torque moment is greatest and favors even more the rotation of the shaft in the opposite direction.

Figure 7:
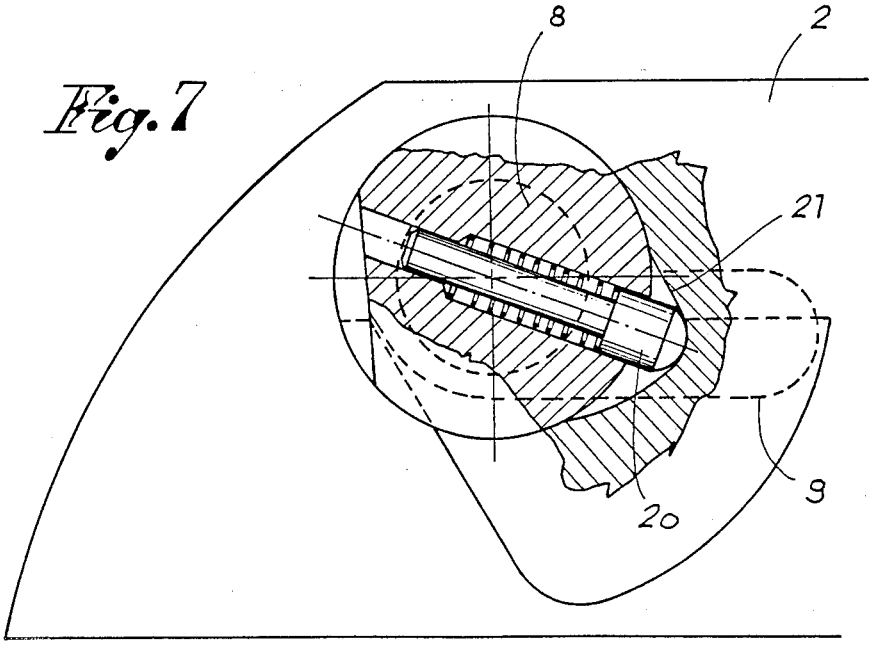
FIG. 7 is a sectional view of the auxiliary means for the blockage of the shaft or rod in a rest or inoperative position.

It is to be observed, finally, that the shaft 8 may be provided, adjacent the control lever 9 with a spring-loaded auxiliary piston 20, which rotates together with the shaft 8 and which cooperates with a cammed hollow or cavity 21 constructed in breech block 2 for defining and establishing the rest or inoperative position of the shaft, as shown particularly in FIG. 7 of the drawings.

While a specific embodiment of the invention has been shown and described in detail to illustrate the application of the principles of the invention, it will be understood that the invention may be embodied otherwise without departing from such principles.

What is claimed is:

1. In a pistol having a body, a breech block movable on said body, a firing pin mounted for movement to said breech block, said firing pin having a first portion movable in a selected direction and a second portion alignable with said first portion for being movable therewith in said selected direction and disalignable with said first portion, a hammer mounted for movement from a cocked position away from said second portion to a firing position toward said second portion for striking said second portion in its aligned position in said selected direction, said hammer having a trip lever for causing said hammer to move from its cocked position to its firing position, a manually rotatable cammed shaft rotatably mounted to said breech block on an axis which is transverse to said selected direction, said second portion being mounted on said cammed shaft for movement from its aligned position to its disaligned position with rotation of said shaft, said cammed shaft having a cam portion, a movably mounted rocking lever movable for engaging said trip lever to move said hammer from its cocked position to its firing position when said cam portion of said cammed shaft engages said rocking lever and as said cammed shaft rotates to move said second portion of said firing pin from its aligned position to its disaligned position, said pistol including a safety block movably mounted to said breech block for blocking movement of said first portion of said firing pin in said selected direction, the improvement comprising a spring loaded pusher mounted for movement to said breech block, said cammed shaft having at least one surface including a step portion located eccentrically of said axis of said cammed shaft, said breech block includes a seat, said spring loaded pusher being mounted for movement in said seat and including a piston movable in said seat and a spring in said seat biasing said piston toward said cam shaft, said surface of said cam shaft includes a portion extending in a substantially radial direction adjacent said step portion having a surface lying in a plane different from said step portion and disposed eccentrically of said axis, said cammed shaft being rotatable manually to an extreme position for moving said second portion of said firing pin to its disaligned position, said piston being engaged with said radial portion surface in said extreme position of said cammed shaft for rotating said cammed shaft away from its extreme position.

2. The improvement of claim 1, wherein said breech block includes a cammed cavity, and a spring loaded auxiliary piston mounted for movement to said cammed shaft and engageable in said cammed cavity for holding said cammed shaft in a position whereat said second portion of said firing pin is in aligned position.

3. In a pistol having a body, a breech block movable on said body, a firing pin mounted for movement to said breech block, said firing pin having a first portion movable in a selected direction and a second portion alignable with said first portion for being movable therewith in said selected direction and disalignable with said first portion, a hammer mounted for movement from a cocked position away from said second portion to a firing position toward said second portion for striking said second portion in its aligned position in said selected direction, said hammer having a trip lever for causing said hammer to move from its cocked position to its firing position, a manually rotatable cammed shaft rotatably mounted to said breech block on an axis which is transverse to said selected direction, said second portion being mounted on said cammed shaft for movement from its aligned position to its disaligned position with rotation of said shaft, said cammed shaft having a cam portion, a movably mounted rocking lever movable for engaging said trip lever to move said hammer from its cocked position to its firing position when said cam portion of said cammed shaft engages said rocking lever and as said cammed shaft rotates to move said second portion of said firing pin from its aligned position to its disaligned position, said pistol including a safety block movably mounted to said breech block for blocking movement of said first portion of said firing pin in said selected direction, the improvement comprising a spring loaded pusher mounted for movement to said breech block, said breech block including a cammed cavity, and a spring loaded piston mounted for movement with respect to said cammed shaft and engageable in said cammed cavity for urging said cammed shaft into a position whereat said second portion of said firing pin is in aligned position.

* * * * *